US006230779B1

(12) United States Patent
Anderson et al.

(10) Patent No.: US 6,230,779 B1
(45) Date of Patent: May 15, 2001

(54) LABELING APPARATUS WITH ENHANCED BELLOWS AND ASSOCIATED METHOD

(75) Inventors: David N. Anderson, Auburndale; Wayne C. Sherman, Lakeland, both of FL (US)

(73) Assignee: FMC Corporation, Lakeland, FL (US)

( * ) Notice: Subject to any disclaimer, the term of this patent is extended or adjusted under 35 U.S.C. 154(b) by 0 days.

(21) Appl. No.: 09/046,219

(22) Filed: Mar. 23, 1998

(51) Int. Cl.[7] ..... B65C 3/00; B65C 9/08; B65C 9/18

(52) U.S. Cl. ..... 156/567; 156/556; 156/566; 156/542; 156/DIG. 5; 271/91; 271/196

(58) Field of Search ..... 156/285, 497, 156/541, 542, 567, 568, 571, 572, DIG. 1, DIG. 2, DIG. 3, DIG. 5, DIG. 6; 198/471.1, 803.5; 221/73, 211, 1; 222/1, 3, 64; 271/91, 196; 417/472, 473; 269/21; 294/64.1, 64.2, 64.3

(56) References Cited

U.S. PATENT DOCUMENTS

| | | | |
|---|---|---|---|
| 1,085,077 | 1/1914 | Ballard . | |
| 2,266,087 | 12/1941 | Schlemmer | 216/28 |
| 2,690,104 | 9/1954 | Schwartz et al. | 93/88 |
| 2,765,205 | 10/1956 | Capella et al. | 312/91 |
| 2,933,216 | 4/1960 | Cole | 221/73 |
| 3,158,522 | 11/1964 | Dreher | 156/519 |
| 3,193,430 | 7/1965 | Messmer et al. | 156/355 |
| 3,423,119 | 1/1969 | Stanley | 294/65 |
| 3,440,123 | 4/1969 | Hamisch, Sr. | 156/384 |
| 3,450,590 | 6/1969 | LaMers | 156/540 |
| 3,611,929 | 10/1971 | Schrotz . | |
| 3,716,307 | 2/1973 | Hansen | 417/191 |
| 3,955,711 | 5/1976 | Schroter et al. . | |
| 4,123,310 | 10/1978 | Varon et al. | 156/351 |
| 4,156,627 | 5/1979 | Hamisch, Jr. . | |
| 4,191,608 | 3/1980 | Bussard et al. . | |
| 4,217,164 | 8/1980 | LaMers . | |
| 4,303,461 | 12/1981 | LaMers . | |
| 4,454,180 | 6/1984 | LaMers . | |
| 4,547,252 | 10/1985 | LaMers | 156/497 |
| 4,648,930 | 3/1987 | LaMers . | |
| 4,726,876 | 2/1988 | Tomsovic, Jr. | 156/552 |
| 4,767,487 | 8/1988 | Tomsovic, Jr. | 156/256 |
| 4,896,793 | 1/1990 | Briggs et al. . | |
| 5,645,680 | 7/1997 | Rietheimer | 156/567 |

FOREIGN PATENT DOCUMENTS

| | | | |
|---|---|---|---|
| 0 113 256 A2 | 12/1983 | (EP) | B65C/9/18 |
| 0 113 256 | 7/1984 | (EP) | B65C/9/18 |

*Primary Examiner*—Richard Crispino
*Assistant Examiner*—Sue A. Purvis
(74) *Attorney, Agent, or Firm*—Leydig, Voit & Mayer, Ltd.

(57) ABSTRACT

A labeler includes at least one bellows movable between extended and retracted positions. The bellows preferably includes a venturi member for applying or maintaining a vacuum to hold the label as the bellows is extended outwardly by positive pressure coupled to the bellows. The labeler preferably includes a positioner for advancing each bellows along a path of travel between a label pick-up position and a label application position, and a controller for controlling fluid flow to retract and extend the bellows as same is advanced along the path of travel. The bellows, in turn, preferably comprises a cap defining a distal end of the bellows for carrying the label and having at least one cap opening therein, a pleated sidewall connected to the cap and having at least one sidewall opening therein, and the venturi member. The venturi member preferably comprises a first seal adjacent the cap to define a first chamber in communication with the at least one cap opening, and a second seal positioned adjacent the first seal to define a second chamber in communication with the at least one sidewall opening. The venturi member also preferably includes a venturi body connected to the first and second seals and having a plurality of passageways therein for generating a low pressure in the first chamber and at the cap openings caused by a venturi effect as fluid flows from a proximal end of the bellows into the second chamber and out the sidewall openings.

40 Claims, 11 Drawing Sheets

LABELING APPARATUS WITH ENHANCED BELLOWS AND ASSOCIATED METHOD

FIELD OF THE INVENTION

This invention relates to the field of labeling, and, more particularly, to a labeling apparatus and associated method, such as for the application of labels to fruit and/or vegetables.

BACKGROUND OF THE INVENTION

Labels are applied to fruit and vegetables in packing houses, where the speed at which the labels are applied, the accuracy of the label application, and the space required by the labeler, i.e. the labeler footprint, are important. Speed is important because the fruit must be packed and shipped quickly so that the shelf life in stores will be as long as possible and the speed of the labeler may be the limiting constraint. This constraint of labeler speed may also result in inefficient use of other equipment and personnel in the packing house, thus increasing the overall cost of operation.

Accuracy, in the form of the successful application of the proper label to the fruit, is important because packing house profitability is adversely affected when a label that would have permitted a higher selling price is not applied to fruit otherwise capable of commanding such a higher price. Space is also important because of the physical configuration of any given packing house. The fruit is transported in a series of lanes, each lane conveying fruit on a plurality of cradles connected to an endless belt, each cradle supporting and locating an individual fruit. The fruit in each lane is sized by conventional sizing means and subsequently conveyed past a plurality of labelers arranged in series or banks, each of the labelers in the series of labelers being loaded with a different label, i.e. a label imprinted with indicia to identify the size of the fruit. The physical arrangement of the packing house often limits, without major reconstruction of the building, the number of banks of labelers it is possible to install.

U.S. Pat. No. 4,547,252 to LaMers discloses a labeling apparatus, such as for fruit, and including an extendable bellows for placing the labels. The bellows is moved past a magazine or cassette which dispenses the labels from a carrier strip. The labels are held in position on the distal end of the bellows by application of a vacuum to the bellows, which also serves to maintain the bellows in a retracted position. As the bellows is moved to an application position adjacent a fruit, positive pressure is applied and the bellows is extended to contact the fruit and apply the label thereto.

As also disclosed in the patent, a tricuspid check valve is integrally formed on the distal end of the bellows. The valve admits air from outside the bellows to the interior of the bellows, but prevents the flow of air out of the bellows. Accordingly, in theory, the label may be held in position by the vacuum applied to maintain the bellows in the retracted position. When the bellows is extended by positive air pressure, the valve in theory is closed to prevent blowing the label off of the end of the bellows and thereby missing the fruit.

Unfortunately, the integrally formed valve may become gummed with adhesive from the adhesive labels or from wax carried by the fruit. If the valve becomes stuck open, when positive pressure is applied, the label may be ejected prematurely. If the valve becomes gummed in a closed position, the bellows may not pick up the labels and the dispensing cassette may jam thereby requiring maintenance.

Published European patent application 113,256 assigned to Sinclair discloses a labeler including a plurality of extendable bellows rotated between label pick-up and label applying positions. In a related commercial embodiment of the Sinclair labeler, a flexible diaphragm has been used in place of the tricuspid check valve. The flexible diaphragm is secured to the inside distal end of the bellows. When a vacuum is applied, the diaphragm opens to expose a series of openings in the distal end. Accordingly, the label is held in position by vacuum communicated to the end openings. When positive pressure is applied to extend the bellows, the flexible diaphragm desirably seals against the openings.

Unfortunately, the diaphragm arrangement may be subject to the same shortcomings as the tricuspid check valve. In other words, the accumulation of adhesive and/or wax could stick the diaphragm in either the opened or closed positions. Accordingly, fruit may not be properly labeled, and additional maintenance may be required for the labeler.

SUMMARY OF THE INVENTION

In view of the foregoing background, it is therefore an object of the present invention to provide a labeling apparatus and associated methods that includes bellows that can effectively apply a vacuum to hold a label in position, that properly place the labels on the fruit, and yet which are also resistant to clogging from the label adhesive or fruit wax.

These and other objects, features and advantages in accordance with the present invention are provided by a labeling apparatus for applying labels to articles and comprising at least one bellows movable between extended and retracted positions. The bellows preferably comprises a venturi member for applying or maintaining a vacuum to hold the label as the bellows is extended outwardly by positive pressure coupled to the bellows. Accordingly, the placement of the label is likely to be more accurate and the label is less likely to be prematurely ejected from the distal end of the bellows. Moreover, there is no check valve or flexible diaphragm at the distal end of the bellows that may become clogged.

More particularly, the labeler preferably includes a positioner for advancing each bellows along a path of travel between a label pick-up position and a label application position, and a controller for controlling fluid flow to retract and extend the bellows as same is advanced along the path of travel. The bellows, in turn, preferably comprises a cap defining a distal end of the bellows for carrying the label and having at least one cap opening therein. A pleated sidewall is preferably connected to the cap and the sidewall has at least one sidewall opening therein.

The venturi member preferably comprises a first seal adjacent the cap to define a first chamber in communication with the at least one cap opening, and a second seal positioned adjacent the first seal to define a second chamber capable of communicating with the at least one sidewall opening. The venturi member also preferably includes a venturi body connected to the first and second seals and having a plurality of passageways therein for generating a low pressure in the first chamber and at the cap openings caused by a venturi effect as fluid flows from a proximal end of the bellows into the second chamber and out the sidewall openings. Accordingly, the venturi member and cooperating seals thereby assist in retaining the label on the cap as the bellows is moved to the extended position during application of the label to the article.

The first seal and the sidewall openings may preferably be relatively positioned so that the first seal covers the sidewall openings when the bellows is in the retracted position. Accordingly, reduced pressure can be more readily maintained to thereby keep the bellows in the retracted position.

The passageways in the venturi body also desirably connect the first chamber in fluid communication with the proximal end of the bellows when the bellows is in the retracted position to thus maintain the label in position as the bellows is moved along the path of travel.

The venturi body preferably has a series of enlarged first passageways connected in fluid communication between the proximal end of the bellows and the second chamber. In addition, the venturi body may further have a series of constricted second passageways connected in fluid communication between the first chamber and respective ones of the series of enlarged first passageways. The constricted passageways coupled to the enlarged passageways creates the venturi effect.

The venturi body may also have a ring shape and wherein the series of enlarged first passageways extend radially outwardly from a central opening therein. A stop may be provided between the venturi member and the cap. The venturi body may comprise a rigid material integrally formed with the first seal, and the venturi body further may have a recess for receiving the second seal therein. The second seal preferably comprises a flexible material in one embodiment.

Peripheral portions of the first seal may contact and sealing engage outermost portions of a first pleat adjacent the cap. In this embodiment, the sidewall openings may extend through a proximal portion or side of the first pleat. In addition, the second seal in this embodiment preferably contacts and sealing engages a proximal portion or side of a second pleat adjacent the first pleat.

The pleated sidewall portion may have a generally cylindrical shape. The positioner may preferably carry and rotatably position a plurality of the bellows. The controller preferably sequentially connects the proximal end of the bellows in fluid communication with negative and positive fluid pressure sources.

A method aspect of the invention is for operating a bellows movable between extended and retracted positions for applying labels to articles. The bellows is preferably of a type comprising a cap defining a distal end of the bellows for carrying the label and having at least one cap opening therein, and a pleated sidewall connected to the cap and having at least one sidewall opening therein. The method preferably comprises the step of generating a low pressure adjacent the at least one cap opening, while fluid flows into a proximal end of the bellows. The step of generating preferably includes positioning a first seal adjacent the cap to define a first chamber in communication with the at least one cap opening. The generating step also preferably includes positioning a second seal adjacent the first seal to define a second chamber capable of communicating with the at least one sidewall opening.

Moreover, the generating step also preferably includes connecting a venturi body to the first and second seals. The venturi body preferably has a plurality of passageways therein for generating a low pressure in the first chamber and at the at least one cap opening. The low pressure is caused by a venturi effect as fluid flows from a proximal end of the bellows, into the second chamber, and out the at least one sidewall opening. The venturi effect assists in retaining the label on the cap as the bellows is moved to the extended position during application of the label to the article. The step of positioning the first seal preferably positions the first seal relative to the at least one sidewall opening so that the first seal covers the at least one sidewall opening when the bellows is in the retracted position.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

The bellows in accordance with the present invention is best appreciated after an initial explanation of the overall labeling apparatus 10. This apparatus is further described in U.S. patent application Ser. No. 08/863,036 now U.S. Pat. No. 5,829,351 filed May 23, 1997 the entire disclosure of which is incorporated herein by reference.

Figure 1:
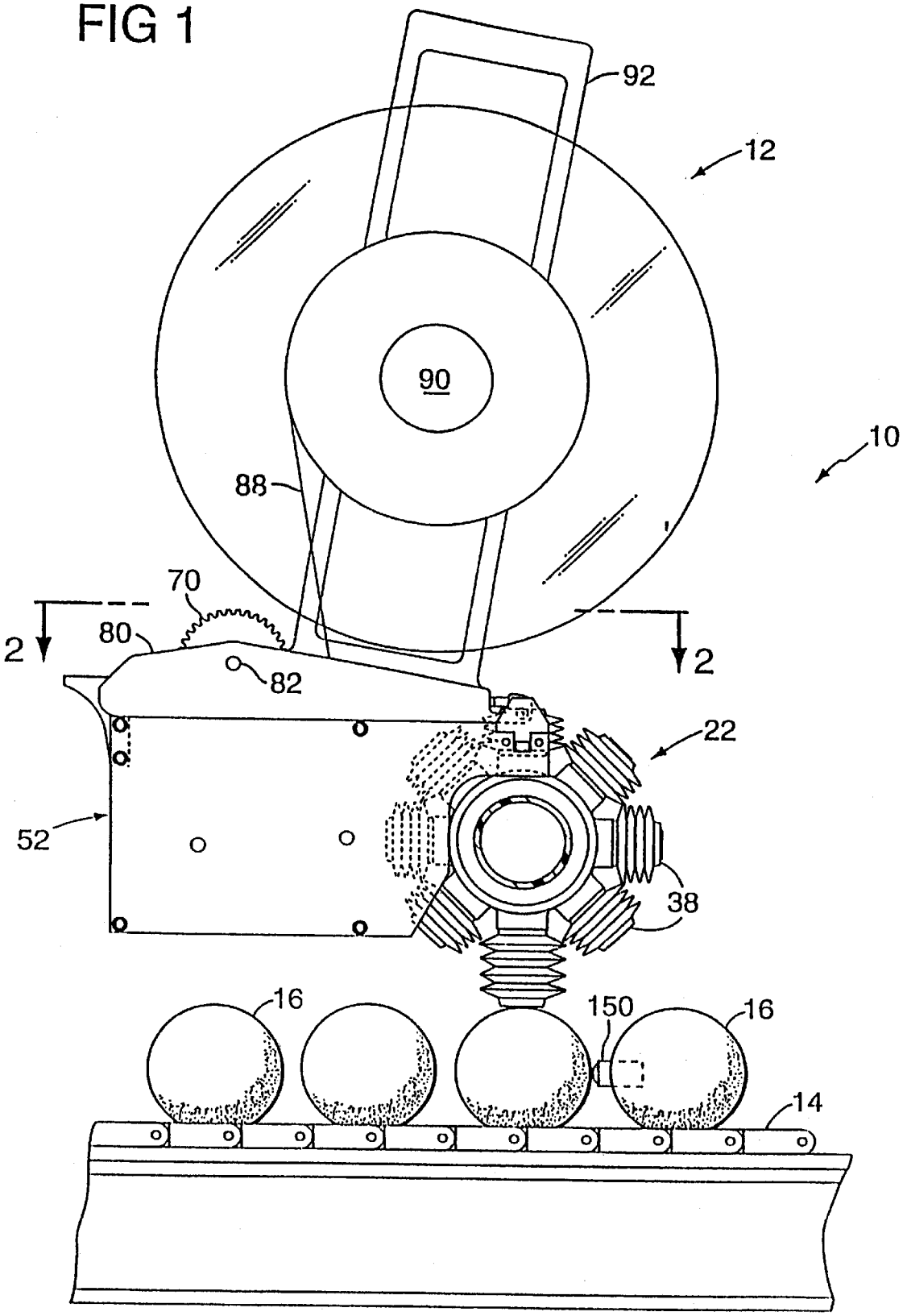
FIG. 1 is a side elevational view of a labeler, with the label cassette installed, according to the present invention.
Figure 2:
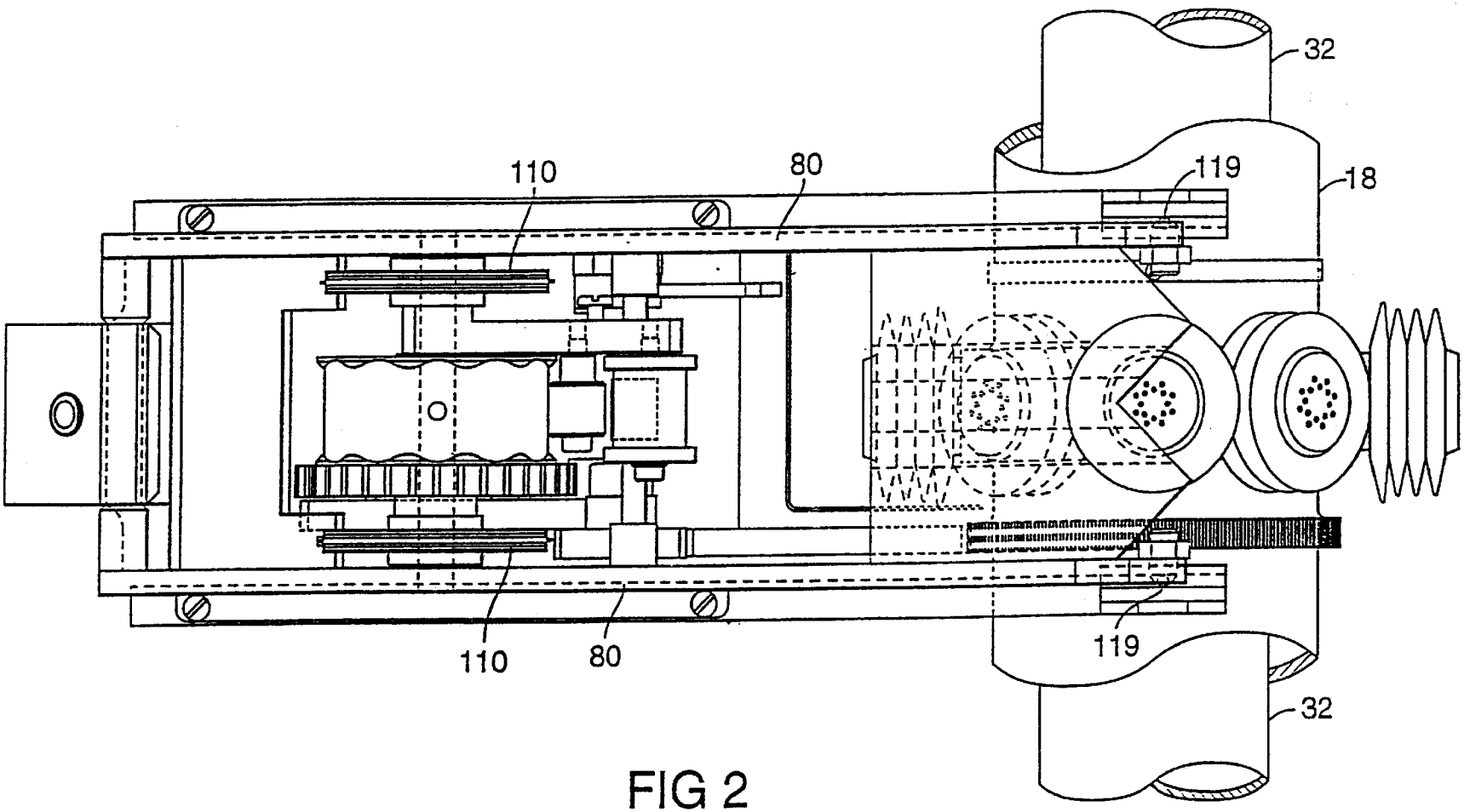
FIG. 2 is a cross-sectional view, taken along line 2—2 of FIG. 1.
Figure 3:
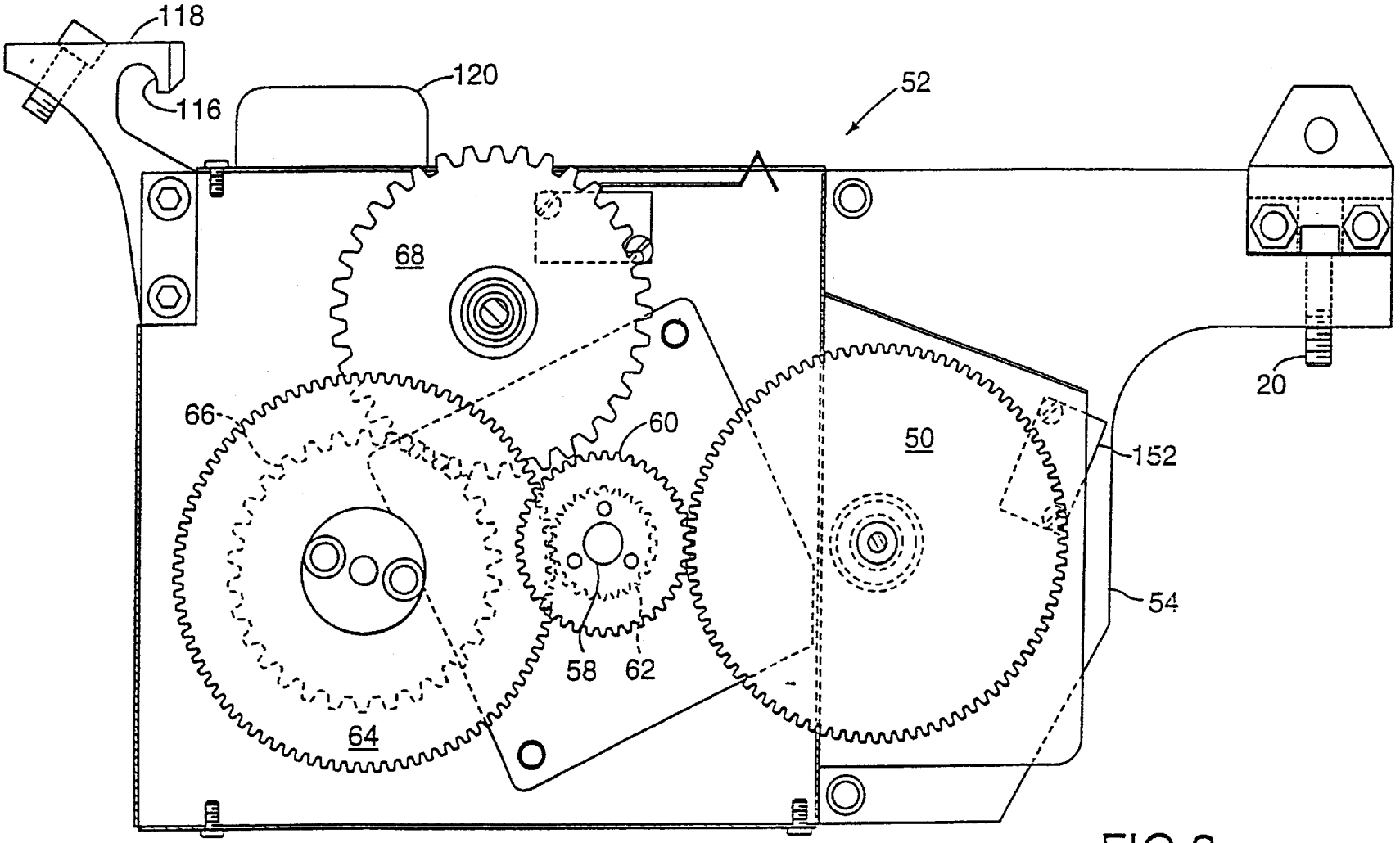
FIG. 3 is a side elevational view, partly in section with parts broken away and eliminated, of the drive train for the labeler of FIG. 1.
Figure 4:
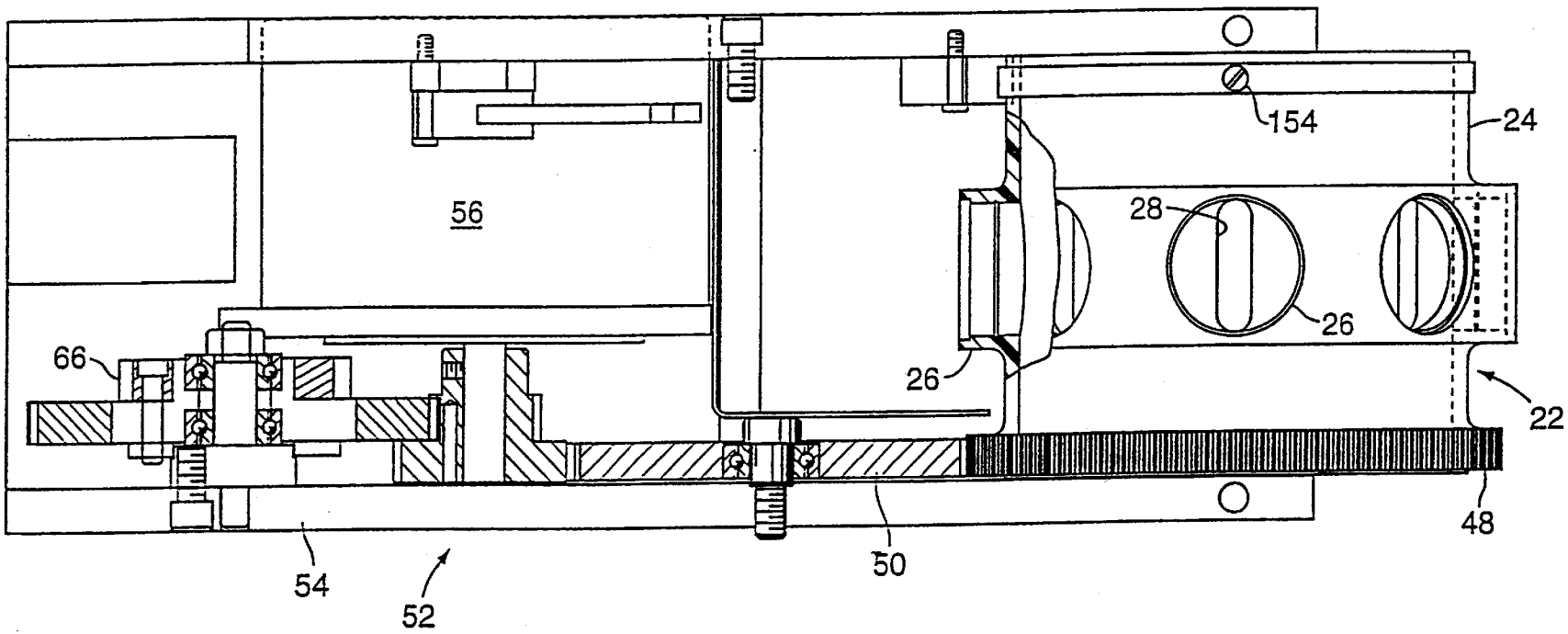
FIG. 4 is a top plan view, partly in section, of the labeler shown in FIG. 1 with the label cassette removed.
Figure 5:
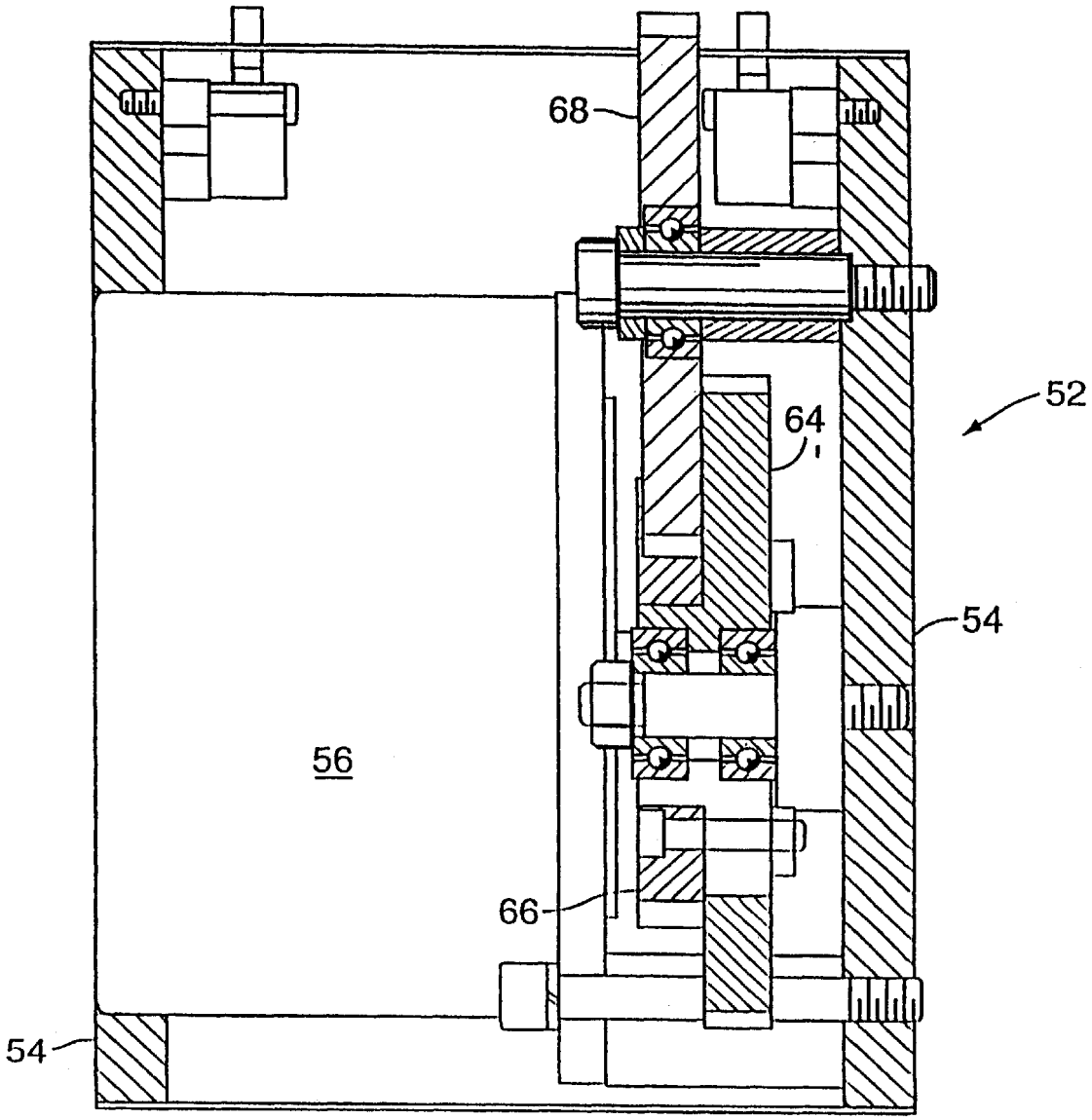
FIG. 5 is an elevational end view of the labeler shown in FIG. 1.
Figure 6:
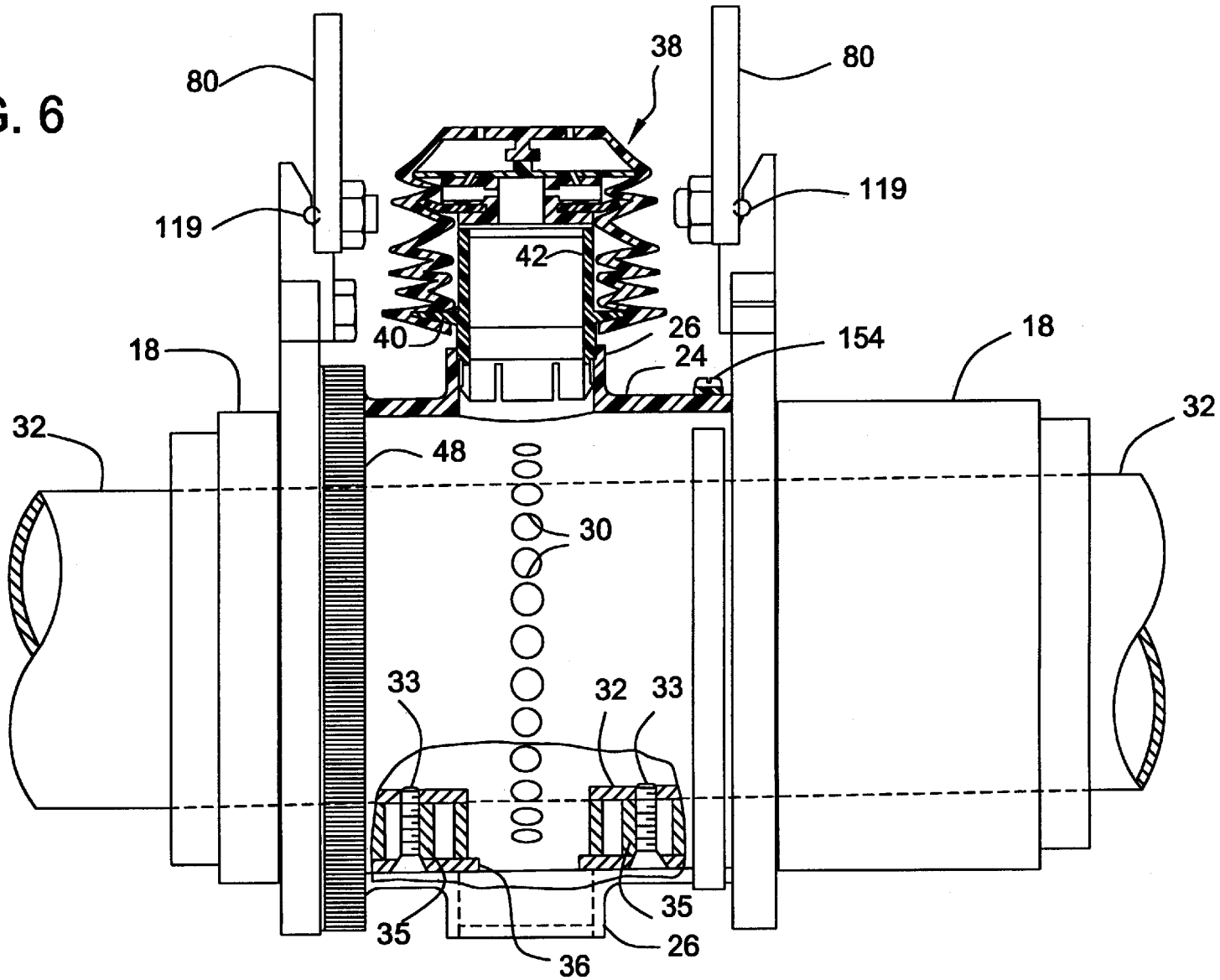
FIG. 6 is a top plan view of a portion of the labeler shown in FIG. 1 showing the bellows wheel.
Figure 7:
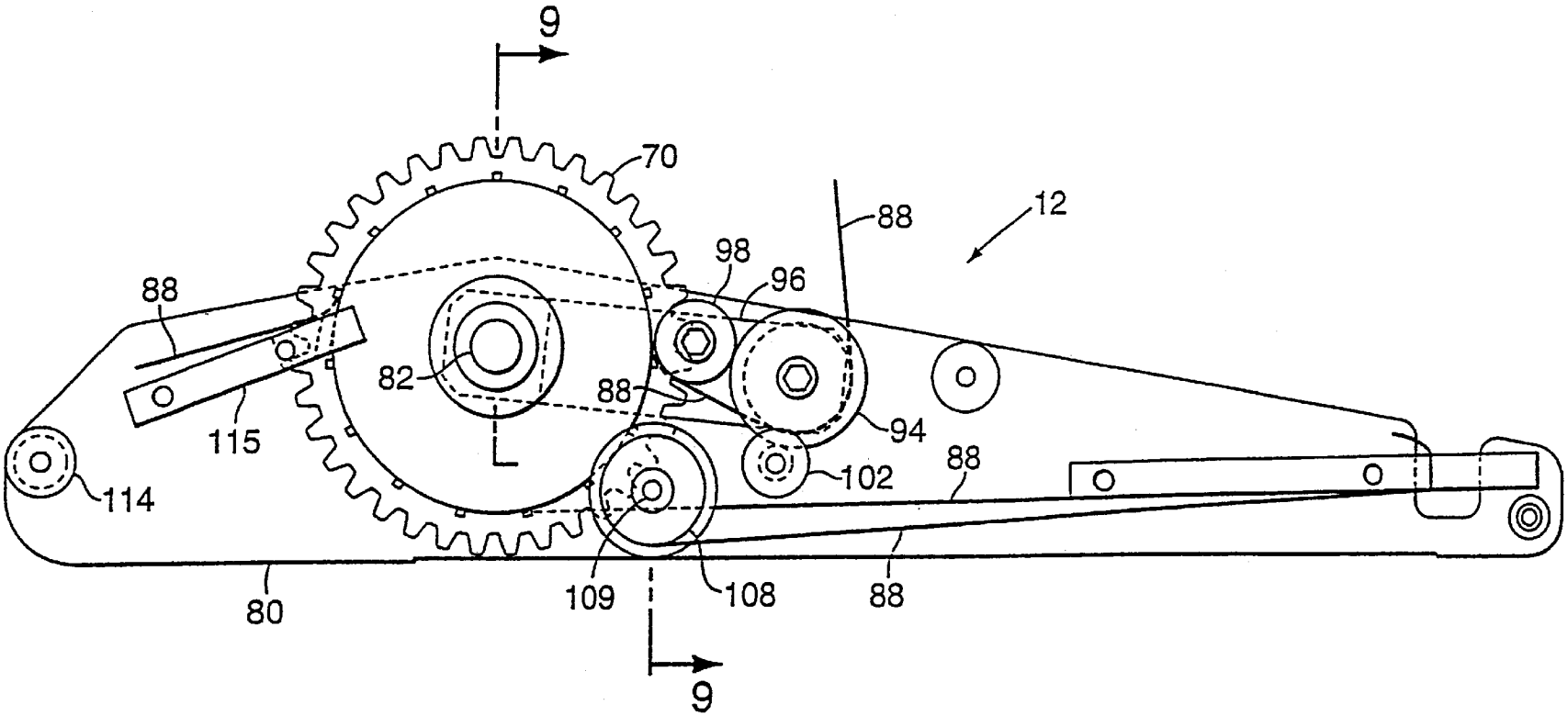
FIG. 7 is a side elevational view of the label cassette for the labeler of FIG. 1.
Figure 8:
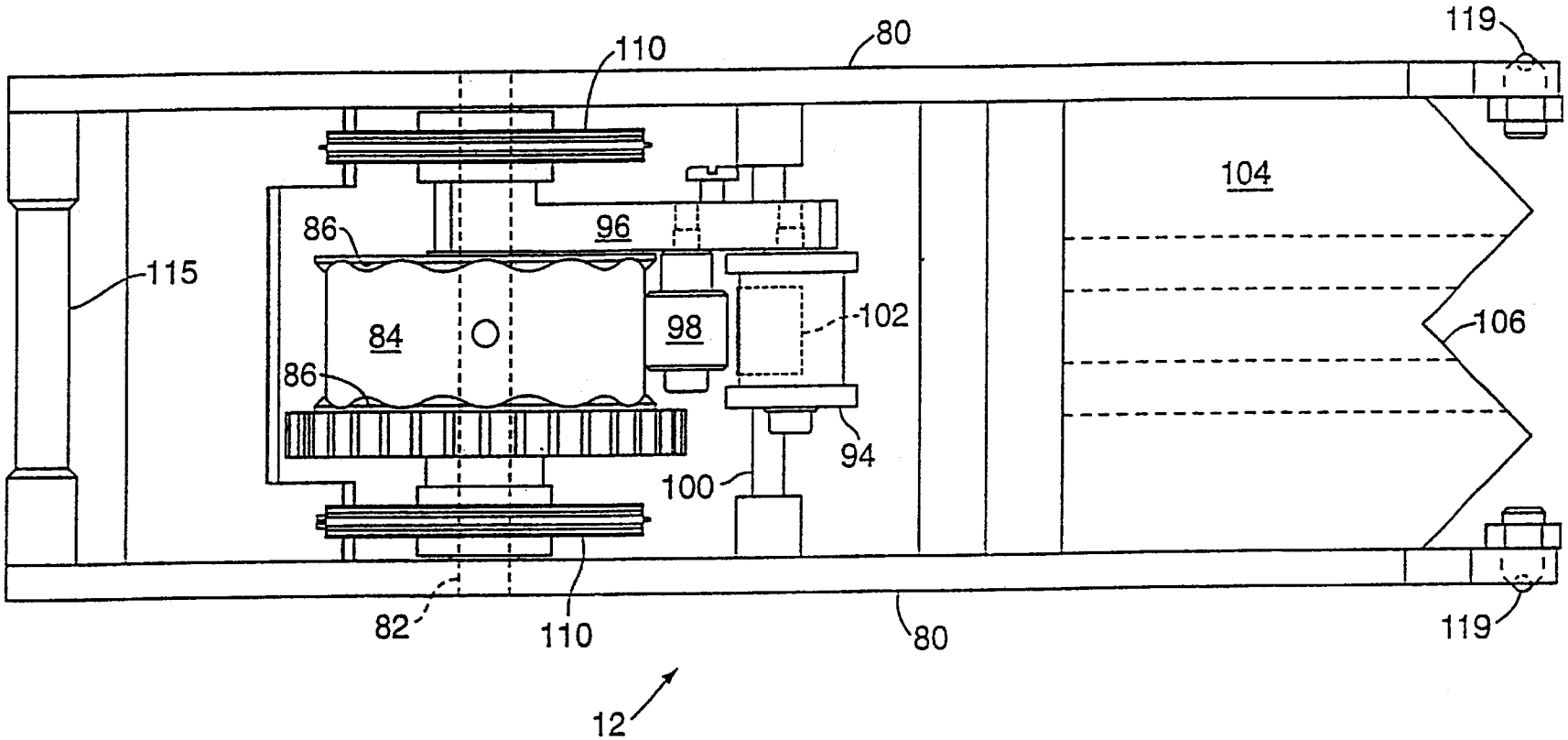
FIG. 8 is a top plan view of the label cassette shown in FIG. 7.
Figure 9:
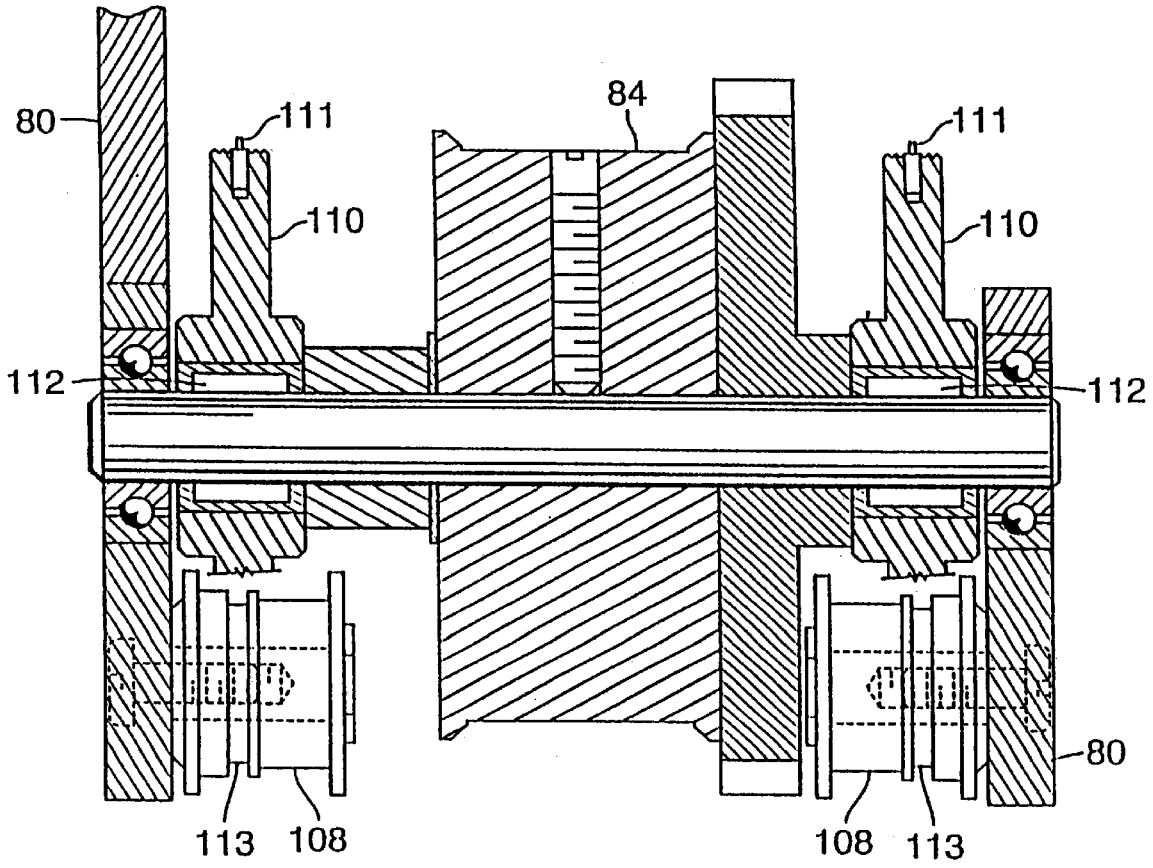
FIG. 9 is a cross-sectional view taken along line 9—9 of FIG. 7.

Referring now to FIG. 1, the labeler 10 includes a label cassette 12 in engagement therewith, supported over a conveyor 14 having conventional cradles for holding and positioning individual fruit 16. The means of such support is through attachment to a vacuum tube 18 by bolts 20 as can be seen in FIG. 3. As best seen from FIGS. 4 and 6, a bellows wheel 22 includes a tubular portion 24 which is rotatable on and sealingly engageable on its ends with the vacuum tube 18. Eight cylindrical projections 26 are provided around the periphery of the tubular member 24 and are positioned with their centers spaced 45 degrees from each other. Each of the cylindrical projections 26 is provided with slot 28 to permit communication with the tube 18, which tube is provided with a plurality of equally spaced radial holes 30 and is connected with a vacuum source.

For ease of manufacture, the vacuum tube 18 is composed of multiple sections joined together and suspended from a pressure tube 32 extending along the interior of the vacuum tube 18. The suspension is by means of bolts 33 extending though the vacuum tube 18 and engaging tapped holes in the pressure tube 32, with spacers 35 maintaining the proper distance between the two tubes 18 and 32. The pressure tube 32 is connected to a source of air pressure, which may be a conventional blower.

For convenience and economy, the source of vacuum for the tube 18 may be the inlet side of the blower supplying air pressure to the tube 32. A cross tube 34 is connected, and communicates air pressure, between the pressure tube 32 and a slot 36 in the vacuum tube 18 at the six o'clock position. The width of the slots 28 in the projections is wider than the space between the holes 30 so that vacuum is always available to each projection 26, except when the projection is at the six o'clock position. As the slot 28 for each projection 26 rotationally approaches that position, vacuum access is interrupted and communication with the pressure slot 36 is initiated.

Similarly, as each projection rotationally leaves the 6 o'clock position, pressure is cut-off just before access to vacuum is permitted. The purpose of this arrangement for vacuum and pressure is to control the timing for extension and retraction of a flexible bellows 38 provided for each of the projections 26.

Each of the bellows 38 is retained by a outward projecting flange 40 on a relatively rigid cup 42 having a slotted end for insertion into a cylindrical projection 26. A lip formed on the slotted end snaps into an internal groove in the projection 26 to releaseably retain the cup 42 in place. Holes in the outer end of the cup 42 communicate pressure or vacuum in the projection 26 to the associated bellows 38. The cup 42 also functions to limit the amount of collapse for the associated bellows when subjected to vacuum. Thus, the bellows 26 are contracted throughout the rotation of the tubular member 24 except when in proximity to the six o'clock position. It is in that position that each of the bellows is extended toward the fruit to effect the application of a label thereto.

The bellows wheel 22 is intermittently rotated by a gear 48 formed on one end of the tubular member 24, which gear meshes with a bellows drive gear 50. A drive assembly, indicated generally at 52, which includes a housing 54 in which the gear 50 is rotatably mounted. A stepper motor 56 is mounted within the housing 54 and has an output shaft 58 with a drive gear 60 attached thereto, which gear 60 meshes with the bellows drive gear 50. A second drive gear 62 is also attached to the output shaft 58 and meshes with an idler gear 64 rotatably mounted in the housing 54.

An idler sprocket 66 is attached to the idler gear 64 and meshes with a cassette drive sprocket 68. The sprocket 68 is rotatably mounted in the housing 54 with its teeth projecting through and above a protective cover secured to the top of the housing to engage the sprocket 70 carried by the cassette 12. In order to accommodate labels of different sizes, the sprocket 66 is removably secured to the gear 64 by bolts 72 so that a sprocket with the number of teeth necessary to advance the label carrier the proper distance may be installed.

The stepper motor 56 is mounted in the housing so that its output shaft 58 is between the rotational mountings of the bellows drive gear 50 and the idler gear 64 and idler sprocket 66, and the rotational mounting of the cassette sprocket is above and between the output shaft and the rotational mountings of the idler gear 64 and idler sprocket 66. This arrangement produces a compact footprint for the labeler 10.

As shown in FIGS. 1 and 7–9, the cassette 12 has a frame 80 with a shaft 82 rotatably mounted therein. The cassette sprocket 70 is affixed to the shaft 82 as is a hub 84 which is centered on the frame. The hub 84 has a depressed center section with sinusoidal side walls 86 projecting toward and away from each other. The edges of the carrier 88 are formed with a shape complementary to and engageable with the sinusoidal side walls 86. The carrier 88 is wound on a shaft 90 which is rotatably supported on handles 92 formed on and extending upward from the frame 80. The carrier 88 is trained around a guide pulley 94 rotatably carried on a tension arm 96 which is loosely carried by the shaft 82.

A second roller 98 rotatably carried by the arm 96 assures the carrier 88 engages the side walls 86. A stepped shaft 100 extends across and is non-rotationally secured to the frame 80. A full diameter section 102 of the shaft 100 is engageable by the guide roller 94 to assure the carrier remains within the side walls thereof. The full diameter section 102 also limits the downward travel of the guide roller 94, which is biased downward by gravity, to trap the carrier 88 there between and arrest the carrier's momentum and to maintain tension therein.

A plate 104 having a V-shaped notch 106 is attached to the frame 80 to split the carrier 88, which is weakened along its centerline for that purpose, and to separate the labels from the carrier as the carrier passes over the notch 106. Each half of the separated carrier passes underneath the plate 104 and around guide rollers 108 rotatably mounted on the frame 80. Each half passes between the rollers 108 and pin wheels 110, passing over the top of the pin wheels 110, which are rotated in a counter-clockwise direction as viewed in FIG. 7. The pin wheels 110 are provided with protruding sharp pins 111 which penetrate the associated half of the carrier, the penetration being aided by a groove 113 in the guide rollers 108.

Each of the pin wheels 110 is mounted by conventional roller clutches 112 on the shaft 82. The clutches 112 permit the pin wheels to free-wheel in a counter-clock wise direction as viewed in FIG. 7, which is the direction the shaft 82 rotates when it is being driven, but do not permit rotation of the pin wheels in a clockwise direction so that tension is maintained on each half of the carrier 88 without causing separation thereof. A wedge 115 secured to the inside of each side of the frame 80 separates the halves of the carrier 88 from the pins 111 on the associated pin wheel 110.

A bar 114 spans one end of the frame 80 and is engageable with a hook 116 formed in the bracket 118 (See FIG. 3). The bracket 118 is secured to the frame 54 of the drive assembly 52. The bar 114 has enlarged diameter ends, the transitions to which tends to center the bar 114 on the bracket 118 and the drive assembly 52 as the bar 114 is positioned under the hook 116, as do the guides 120 formed on the top cover for the frame 54. A spring-loaded detent 119 is mounted on each side of the cassette frame 80 and engages a recess on the frame 54 to releaseably retain the cassette in place on the drive assembly (See FIGS. 6 & 8). The cassettes are interchangeable so that one cassette can be loaded off-line with a reel of a carrier bearing labels while another cassette is operatively engaged with the labeler 14 to apply labels to the fruit.

The stepper motor 56 is activated or energized for rotation of its output shaft 58 by a fruit sensing switch 150 positioned beside the conveyor 14 to detect the approach of a fruit in a cradle on the conveyor. Once energized, the stepper motor 56 accelerates from standstill to a rotational speed which causes the velocity of the end of the bellows 38 to match that of the conveyor 14, which may be determined by counting the rotations of an idler sprocket (not shown) engaging the conveyor, and then decelerates to standstill. The acceleration or ramp-up of the motor 56 from standstill, which is initiated by closing of sensing switch 150, is a function of the speed of the conveyor 14, the distance between the cradles thereon carrying the fruit, and the maximum tensile force to which the carrier 88 may be subjected.

A proximity switch 152 mounted on the frame 54 detects the head of a plurality of small metal screw 154 secured to the bellows wheel 22, with each screw 154 being positioned adjacent one of the projections 26. The deceleration or ramp-down is initiated by the proximity switch 152 closing upon the approach of the next head of screw 154 and is a mirror image of the acceleration.

Activation of the motor 56 causes the gears 60 and 62 to be rotated in a clockwise direction as viewed in FIG. 3, which results in both the bellows wheel 22 and the cassette drive sprocket 68 being driven in the same direction. Because there is a direct connection between the drive of both the bellows wheel and the cassette, a full bellows cycle, i.e. the full 45 degrees between individual bellows, is available to effect the transfer of a label from the carrier to the end of an individual bellows. As a consequence, lower velocities of tape speeds are required and the transfer of labels to the ends of the individual bellows is more reliable, with fewer labels missing and with greater accuracy of placement. Additionally, the labeler is capable of higher speeds, because each individual bellows 38 need move through an arc of only 45 degrees, rather than 60 degrees as required by the prior art.

Turning now additionally to FIGS. 10–16, the enhanced features of the bellows 38 are further described. The bellows 38 illustratively includes a venturi member 40 for applying or maintaining a vacuum to hold the label 41 to the bellows. As described above, the labeler includes a positioner for advancing each bellows 38 along a path of travel between a label pick-up position and a label application position, and a controller for controlling fluid flow to retract and extend the bellows as same is advanced along the path of travel.

The bellows 38 illustratively includes a cap 42 defining a distal end of the bellows for carrying the label 41 and having a plurality of cap openings 43 therein. The bellows 38 also includes a pleated sidewall 45 connected to the cap and having a plurality of sidewall openings 46 therein. More particularly, the sidewall openings are on a proximal face or side of the first pleat 45*a* adjacent the cap 42 as shown in the illustrated embodiment.

The venturi member 40 includes a first seal 47 which is positioned adjacent the cap 42 to define a first chamber 51 in communication with the cap openings 43. In the illustrated embodiment, the first seal 47 is formed of a rigid material, and may preferably be integrally formed with the venturi body 53. In other embodiments, the first seal 47 may be a separate annular piece mounted to the venturi body 53 as will be readily appreciated by those skilled in the art.

The venturi member 40 also illustratively includes a second seal 55 positioned adjacent the first seal 47 to define a second chamber 57 which may be in fluid communication with the sidewall openings 46 depending on whether the bellows is in the retracted or extended position as will be explained in greater detail below. The second seal 55 may be in the form of a flexible annular member received in a recess in the venturi body 53 as shown in the illustrated embodiment. As will be readily appreciated by those skilled in the art, the second seal 55 may be integrally formed with the venturi body 53 or may be mounted in a different arrangement in alternate embodiments of the invention.

Figure 11:
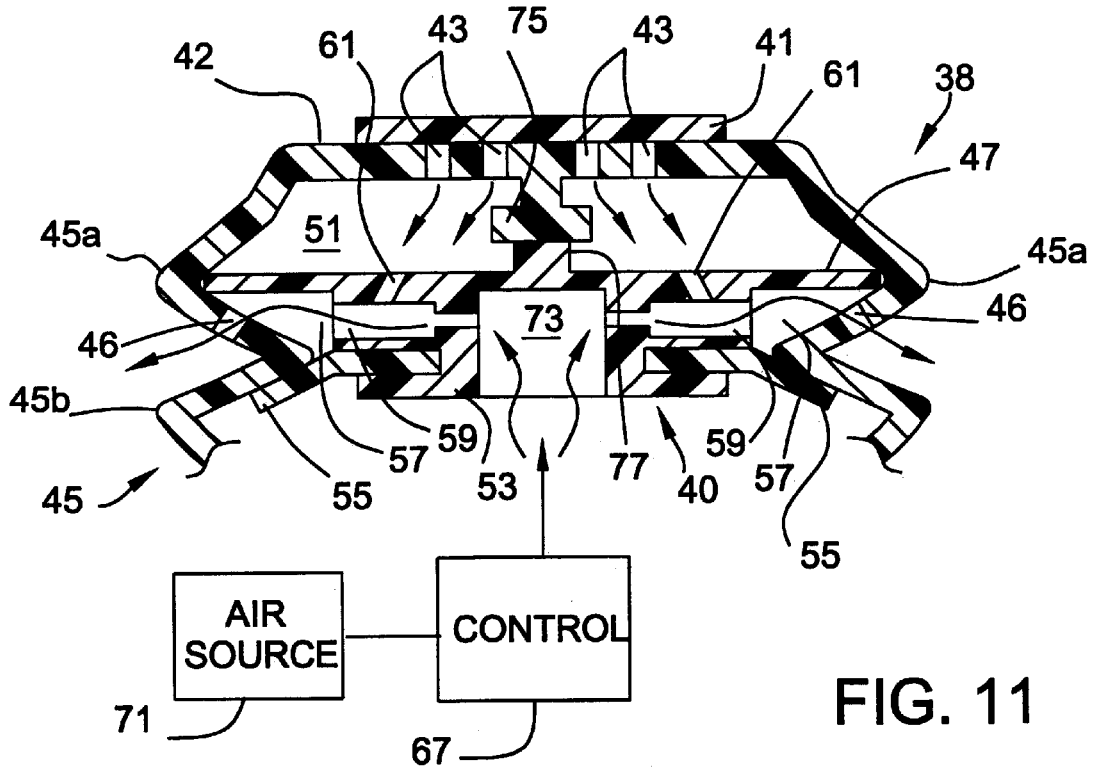
FIG. 11 is a cross-sectional view of the bellows portion as shown in FIG. 10 in the extended position.
Figure 12:
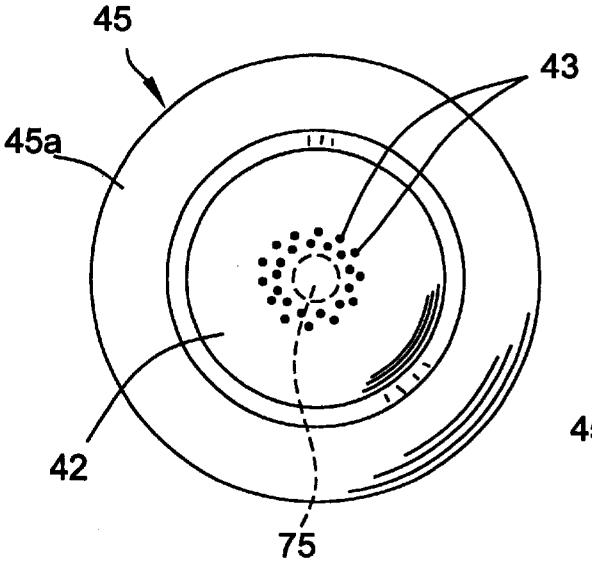
FIG. 12 is a top plan view of the distal end of the bellows without a label in position in accordance with the present invention.
Figure 13:
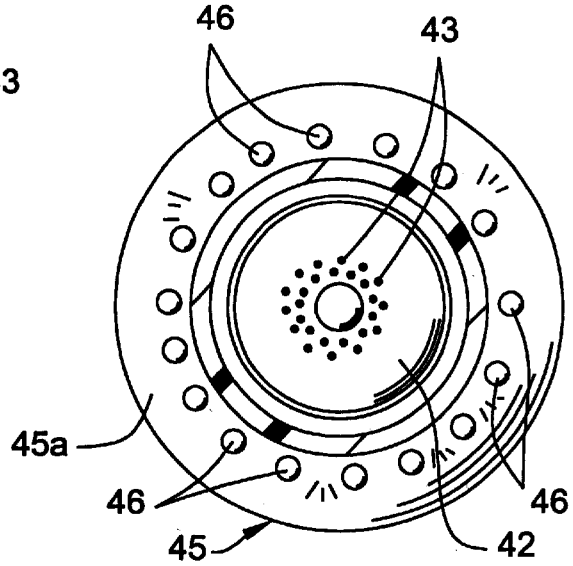
FIG. 13 is a cross-sectional view taken after the first pleat of the pleated sidewall of the bellows in accordance with the present invention.
Figure 14:
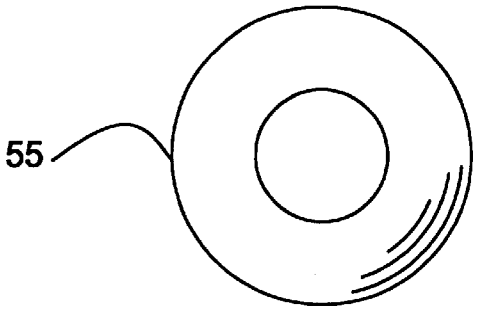
FIG. 14 is a top plan view of the flexible seal used in the bellows in accordance with the present invention.
Figure 15:
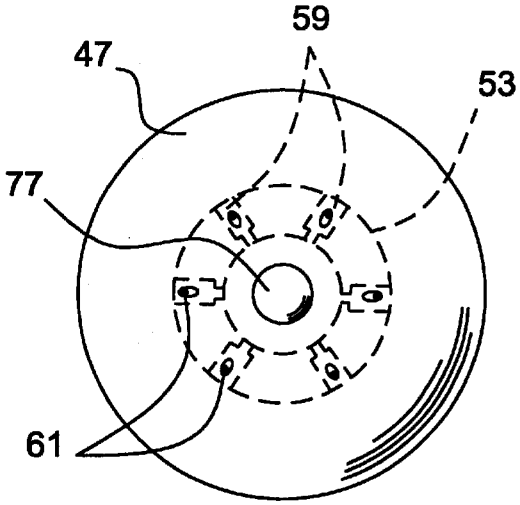
FIG. 15 is a top plan view of the venturi body and integrally formed seal of the bellows in accordance with the present invention.
Figure 16:
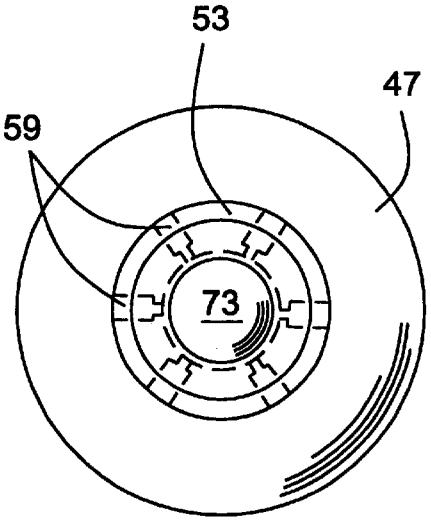
FIG. 16 is a bottom plan view of the venturi body as shown in FIG. 15.

The venturi body 53 also includes a plurality of passageways 59, 61 therein for generating a low pressure in the first chamber 51 and at the cap openings 43 caused by a venturi effect as air or other fluid flows from a proximal end of the bellows 38, into the second chamber 57, and out the sidewall openings 46 as seen perhaps best in FIG. 11. The venturi body 53 has a series of enlarged first passageways 59 connected in fluid communication between the proximal end of the bellows 38 and the second chamber 57. The venturi body 53 also has a series of constricted second passageways 61 connected in fluid communication between the first chamber 51 and respective ones of the series of enlarged first passageways 59. In the illustrated embodiment, the enlarged passageways 59 extend outwardly in a radial direction from a central opening or passageway 73, and the constricted passageways 61 are angled to couple to their respective radially extending enlarged passageways. As will be readily understood by those skilled in the art, the constricted passageways 61, as coupled to the flow of air through the enlarged passageways 59, creates the venturi effect. The venturi member 40 provides means for generating a low pressure adjacent the cap openings 43 while fluid flows into a proximal end of the bellows as the bellows is extended.

In slightly different terms, the venturi member 40 and its cooperating seals 47, 55 thereby assist in retaining the label 41 on the cap 42 as the bellows 38 is moved to the extended position during application of the label to the article as can be seen in FIG. 11, where the proximal end of the bellows is schematically coupled to the illustrated air source 65 via the controller 67. Accordingly, the placement of the label 41 onto the fruit is likely to be more accurate, and the label is less likely to be prematurely ejected from the cap 42 of the bellows 38. The operation of the air source 65 and controller 67 have been extensively described above and need no further description.

Figure 10:
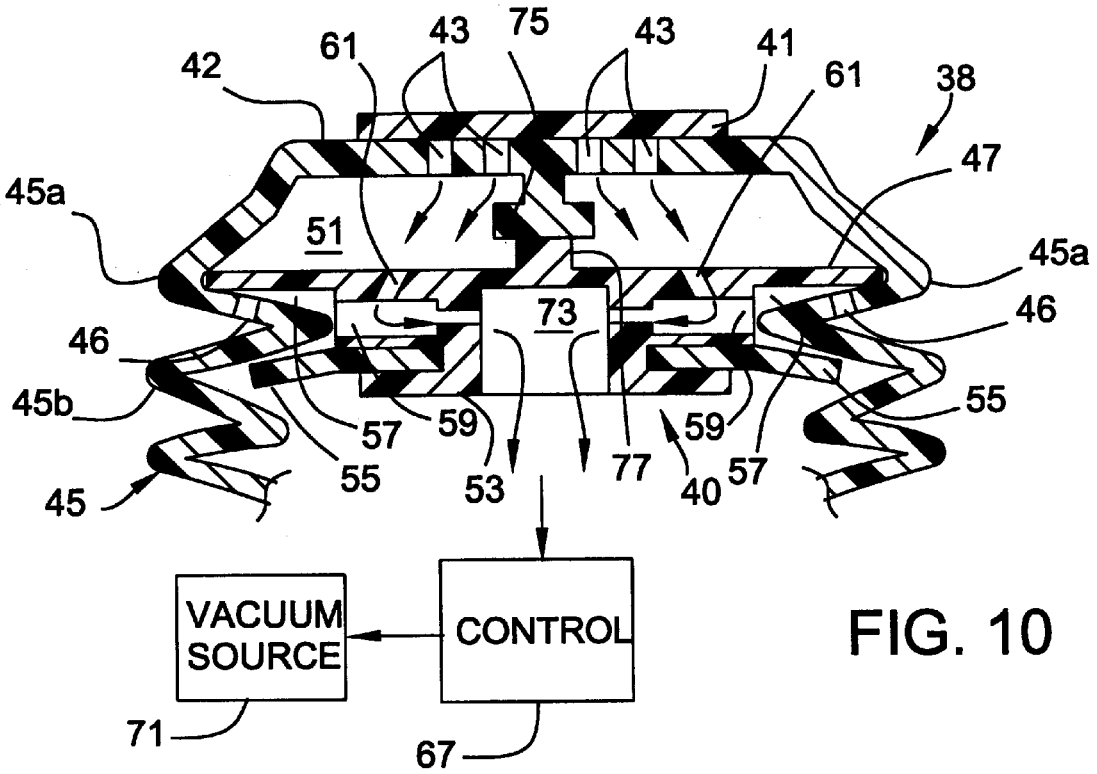
FIG. 10 is a cross-sectional view of a portion of the bellows in a retracted positioned and holding a label in accordance with the present invention.

Another advantageous feature of the bellows 38 is that the sidewall openings 46 are sealed by the first seal 47 when the bellows is in the retracted position as perhaps best understood with particular reference to FIG. 10. In other words, the first seal 47 and the sidewall openings 46 may preferably be relatively positioned so that the first seal covers the sidewall openings when the bellows is in the retracted position.

The reduced pressure or vacuum, when the bellows is in the retracted position, is communicated to the first chamber 51 via the passageways 59, 61 as will be readily appreciated by those skilled in the art. The reduced pressure or vacuum can be more readily maintained to thereby keep the bellows in the retracted position by closing the sidewall openings 46. In FIG. 10 the proximal end of the bellows 38 is schematically coupled to a vacuum or negative pressure source 71 via the controller 67.

A stop may be defined by a first member or projection 75 on the inside of the cap 42 and a second correspondingly aligned projection 77 on the venturi member 40. Thus, the first chamber 51 is prevented from collapsing, and perhaps blocking communication between the cap openings 43 and the constricted passageways 61 in the venturi body 53.

Peripheral portions of the first seal 47 may contact and sealingly engage outermost portions of the first pleat 45*a* adjacent the cap 42 as shown in the illustrated embodiment. The sidewall openings 46 extend through a proximal portion of the first pleat 45*a*, and the second seal 55 contacts and sealing engages a second pleat 45*b* adjacent the first pleat.

The bellows 38, including the venturi member 40, cap openings 43, and sidewall openings 46 overcomes the limitations of the prior art check valve and diaphragm arrangements. The prior art approaches were subject to becoming stuck in the open or closed position, such as caused by an accumulation of label adhesive and/or wax carried by the fruit. The bellows 38 in accordance with the present invention has no check valve associated with the cap openings 43 and no diaphragm to selectively cover the cap openings. Rather, vacuum can be applied to the cap openings 43 throughout the entire machine cycle as will be readily appreciated by those skilled in the art. The venturi member 40 permits the bellows 38 to be expanded by coupling to positive pressure, yet still provides a vacuum to the label 41 to maintain the label in the proper position until placed on the fruit.

A method aspect of the invention is for operating a bellows 38 movable between extended and retracted positions for applying labels to articles. The bellows 38 is preferably of a type comprising a cap 42 defining a distal end of the bellows for carrying the label 41 and having at least one cap opening 43 therein, and a pleated sidewall 45 connected to the cap and having at least one sidewall opening 46 therein. The method preferably comprises the step of generating a low pressure adjacent the at least one cap opening 43, while fluid flows into a proximal end of the bellows.

The step of generating preferably includes positioning a first seal 47 adjacent the cap 42 to define a first chamber 51 in communication with the at least one cap opening 43. The generating step also preferably includes positioning a second seal 55 adjacent the first seal to define a second chamber 57 capable of communicating with the at least one sidewall opening 46. Moreover, the generating step also preferably includes connecting a venturi body 53 to the first and second seals. The venturi body 53 preferably has a plurality of passageways 59, 61 therein for generating a low pressure in the first chamber 51 and at the at least one cap opening 43 caused by a venturi effect as fluid flows from a proximal end of the bellows, into the second chamber, and out the at least one sidewall opening. The venturi effect assists in retaining the label 41 on the cap 42 as the bellows is moved to the extended position during application of the label to the article. The step of positioning the first seal 47 preferably positions the first seal relative to the at least one sidewall opening 46 so that the first seal covers the at least one sidewall opening when the bellows is in the retracted position.

Many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that modifications and embodiments are intended to be included within the scope of the appended claims.

That which is claimed is:

1. A labeling apparatus for applying labels to articles and comprising:

at least one bellows movable between extended and retracted positions;

a positioner for advancing said at least one bellows along a path of travel between a label pick-up position and a label application position; and a controller for controlling fluid flow to retract and extend said at least one bellows as same is advanced along the path of travel;

said at least one bellows comprising a cap defining a distal end of said bellows for carrying the label and having at least one cap opening therein, a pleated sidewall connected to said cap and having at least one sidewall opening therein, and a venturi member comprising a first seal adjacent said cap to define a first chamber in communication with said at least one cap opening, a second seal positioned adjacent said first seal to define a second chamber capable of communicating with said at least one sidewall opening, and a venturi body connected to said first and second seals and having a plurality of passageways therein for generating a low pressure in said first chamber and at said at least one cap opening caused by a venturi effect as fluid flows from a proximal end of said bellows into said second chamber and out said at least one sidewall opening to thereby assist in retaining the label on said cap as said bellows is moved to the extended position during application of the label to the article.

2. A labeling apparatus according to claim 1 wherein said first seal and said at least one sidewall opening are relatively positioned so that said first seal covers said at least one sidewall opening when said bellows is in the retracted position.

3. A labeling apparatus according to claim 1 wherein said passageways in said venturi body connect said first chamber in fluid communication with the proximal end of said bellows to maintain the label on the distal end responsive to negative pressure applied thereto as the bellows is advanced along the path of travel.

4. A labeling apparatus according to claim 1 wherein said venturi body has a series of enlarged first passageways connected in fluid communication between the proximal end of said bellows and said second chamber.

5. A labeling apparatus according to claim 4 wherein said venturi body further has a series of constricted second passageways connected in fluid communication between said first chamber and respective ones of said series of enlarged first passageways.

6. A labeling apparatus according to claim 4 wherein said venturi body has a ring shape and wherein said series of enlarged first passageways extend radially outwardly from a central opening therein.

7. A labeling apparatus according to claim 1 further comprising a stop positioned between said venturi member and said cap.

8. A labeling apparatus according to claim 1 wherein said venturi body comprises a rigid material; and wherein said venturi body is integrally formed with said first seal.

9. A labeling apparatus according to claim 1 wherein said venturi body further comprises a recess for receiving said second seal therein.

10. A labeling apparatus according to claim 1 wherein said second seal comprises a flexible material.

11. A labeling apparatus according to claim 1 wherein one of said first and second seals comprises a flexible material and the other comprises a rigid material.

12. A labeling apparatus according to claim 1 wherein peripheral portions of said first seal contact and sealing engage outermost portions of a first pleat adjacent said cap.

13. A labeling apparatus according to claim 12 wherein said at least one sidewall opening extends through a proximal portion of the first pleat.

14. A labeling apparatus according to claim 12 wherein said second seal contacts and sealing engages a second pleat adjacent the first pleat.

15. A labeling apparatus according to claim 1 wherein said pleated sidewall has a generally cylindrical shape.

16. A labeling apparatus according to claim 1 wherein said at least one bellows comprises a plurality of bellows.

17. A labeling apparatus according to claim 1 wherein said positioner comprises means for rotatably positioning said at least one bellows.

18. A labeling apparatus according to claim 1 wherein said controller comprises means for sequentially connecting the proximal end of said bellows in fluid communication with negative and positive fluid pressure sources.

19. A labeling apparatus for applying labels to articles and comprising:

at least one bellows movable between extended and retracted positions;

a positioner for advancing said at least one bellows along a path of travel between a label pick-up position and a label application position; and a controller for controlling fluid flow to retract and extend said at least one bellows as same is advanced along the path of travel;

said at least one bellows comprising a cap defining a distal end of said bellows for carrying the label and having at least one cap opening therein, a pleated sidewall connected to said cap and having at least one sidewall opening therein, and venturi means for generating a low pressure adjacent said at least one cap opening while fluid flows into a proximal end of said bellows, said venturi means comprising a first seal adjacent said cap to define a first chamber in communication with said at least one cap opening, a second seal positioned adjacent said first seal to define a second chamber capable of communicating with said at least one sidewall opening and a venturi body connected to said first and second seals and having a plurality of passageways therein for generating a low pressure in said first chamber and at said at least one cap opening caused by a venturi effect as fluid flows from a proximal end of said bellows into said second chamber and out said at least one sidewall opening to thereby assist in retaining the label on said cap as said bellows is moved to the extended position during application of the label to the article.

20. A labeling apparatus according to claim 19 wherein said first seal and said at least one sidewall opening are relatively positioned so that said first seal covers said at least one sidewall opening when said bellows is in the retracted position.

21. A labeling apparatus according to claim 19 wherein said passageways in said venturi body connect said first chamber in fluid communication with the proximal end of said bellows to maintain the label on the distal end responsive to negative pressure applied thereto as the bellows is advanced along the path of travel.

22. A labeling apparatus according to claim 19 wherein said venturi body has a series of enlarged first passageways connected in fluid communication between the proximal end of said bellows and said second chamber.

23. A labeling apparatus according to claim 22 wherein said venturi body further has a series of constricted second passageways connected in fluid communication between said first chamber and respective ones of said series of enlarged first passageways.

24. A labeling apparatus according to claim 22 wherein said venturi body has a ring shape and wherein said series of enlarged first passageways extend radially outwardly from a central opening therein.

25. A labeling apparatus according to claim 19 further comprising a stop positioned between said venturi member and said cap.

26. A labeling apparatus according to claim 19 wherein said venturi body comprises a rigid material; and wherein said venturi body is integrally formed with said first seal.

27. A labeling apparatus according to claim 19 wherein peripheral portions of said first seal contact and sealing engage outermost portions of a first pleat adjacent said cap.

28. A labeling apparatus according to claim 27 wherein said at least one sidewall opening extends through a proximal portion of the first pleat.

29. A bellows movable between extended and retracted positions for applying labels to articles and comprising:

a cap defining a distal end of said bellows for carrying the label and having at least one cap opening therein;

a pleated sidewall connected to said cap and having at least one sidewall opening therethrough; and venturi means for generating a low pressure adjacent said at least one cap opening while fluid flows into a proximal end of said bellows, said venturi means comprising a first seal adjacent said cap to define a first chamber in communication with said at least one cap opening, a second seal positioned adjacent said first seal to define a second chamber capable of communicating with said at least one sidewall opening, and a venturi body connected to said first and second seals and having a plurality of passageways therein for generating a low pressure in said first chamber and at said at least one cap opening caused by a venturi effect as fluid flows from a proximal end of said bellows into said second chamber and out said at least one sidewall opening to thereby assist in retaining the label on said cap as said bellows is moved to the extended position during application of the label to the article.

30. A bellows according to claim 29 wherein said first seal and said at least one sidewall opening are relatively positioned so that said first seal covers said at least one sidewall opening when said bellows is in the retracted position.

31. A bellows according to claim 29 wherein said passageways in said venturi body connect said first chamber in fluid communication with the proximal end of said bellows to maintain the label on the distal end responsive to negative pressure applied thereto as the bellows is advanced along the path of travel.

32. A bellows according to claim 29 wherein said venturi body has a series of enlarged first passageways connected in fluid communication between the proximal end of said bellows and said second chamber.

33. A bellows according to claim 32 wherein said venturi body further has a series of constricted second passageways connected in fluid communication between said first chamber and respective ones of said series of enlarged first passageways.

34. A bellows according to claim 32 wherein said venturi body has a ring shape and wherein said series of enlarged first passageways extend radially outwardly from a central opening therein.

35. A bellows according to claim 29 further comprising a stop positioned between said venturi member and said cap.

36. A bellows according to claim 29 wherein said venturi body comprises a rigid material; and wherein said venturi body is integrally formed with said first seal.

37. A bellows according to claim 29 wherein peripheral portions of said first seal contact and sealing engage outermost portions of a first pleat adjacent said cap.

38. A bellows according to claim 37 wherein said at least one sidewall opening extends through a proximal portion of the first pleat.

39. A method for operating a bellows movable between extended and retracted positions for applying labels to articles, the bellows of a type comprising a cap defining a distal end of said bellows for carrying the label and having at least one cap opening therein, and a pleated sidewall connected to said cap, the method comprising the step of:

generating a low pressure adjacent said at least one cap opening while fluid flows into a proximal end of said bellows, wherein the generating step comprises the steps of:

positioning a first seal adjacent said cap to define a first chamber in communication with said at least one cap opening;

positioning a second seal adjacent said first seal to define a second chamber capable of communicating with at least one sidewall opening in said pleated sidewall; and connecting a venturi body to said first and second seals, said venturi body having a plurality of passageways therein for generating a low pressure in said first chamber and at said at least one cap opening caused by a venturi effect as fluid flows from a proximal end of said bellows into said second chamber and out said at least one sidewall opening to thereby assist in retaining the label on said cap as said bellows is moved to the extended position during application of the label to the article.

40. A method according to claim 39 wherein the step of positioning said first seal comprises positioning same relative to said at least one sidewall opening so that said first seal covers said at least one sidewall opening when said bellows is in the retracted position.

* * * * *